US007261017B2

(12) United States Patent
Jensen et al.

(10) Patent No.: US 7,261,017 B2
(45) Date of Patent: Aug. 28, 2007

(54) STABILIZER LINK REMOVAL TOOL FOR VEHICLES

(75) Inventors: Jarrel G. Jensen, Kansas City, MO (US); Michael L. Whitehead, Clarinda, IA (US)

(73) Assignee: Lisle Corporation, Clarinda, IA (US)

( * ) Notice: Subject to any disclaimer, the term of this patent is extended or adjusted under 35 U.S.C. 154(b) by 0 days.

(21) Appl. No.: 11/260,539

(22) Filed: Oct. 27, 2005

(65) Prior Publication Data

US 2007/0095173 A1 May 3, 2007

(51) Int. Cl.
*B25B 13/06* (2006.01)

(52) U.S. Cl. ..... 81/55; 81/124.5; 81/13

(58) Field of Classification Search ..... 81/55, 81/13, 124.3–124.7
See application file for complete search history.

(56) References Cited

U.S. PATENT DOCUMENTS 956,467 A * 4/1910 Anderson ..... 81/55
1,957,905 A * 5/1934 Hartwell ..... 81/55
2,772,590 A * 12/1956 William ..... 81/55
2,790,343 A * 4/1957 White ..... 81/55
3,779,105 A * 12/1973 Triplett et al. ..... 81/124.5
3,889,558 A * 6/1975 Duncan ..... 81/55
4,305,438 A * 12/1981 Spinosa et al. ..... 81/124.3
6,598,500 B1 * 7/2003 Chivington ..... 81/55

OTHER PUBLICATIONS

Lisle Corporation; Stabilizer Link Removal on Ford Vehicles; Invention Disclosure Agreement, signed Mar. 23, 2005 by Jerry Jensen.

* cited by examiner

*Primary Examiner*—Hadi Shakeri
(74) *Attorney, Agent, or Firm*—Banner & Witcoff, Ltd.

(57) ABSTRACT

A tool for removal of a stabilizer link in vehicles includes a first socket adapted to rotationally receive a second socket attached to the shaped end of a threaded bolt. A socket drive rotates the second socket relative to the first socket as the first socket is placed over a nut on the threaded bolt. The first socket includes an attached handle which is gripped to prevent undesirable rotation of the first socket relative to the second socket.

3 Claims, 3 Drawing Sheets

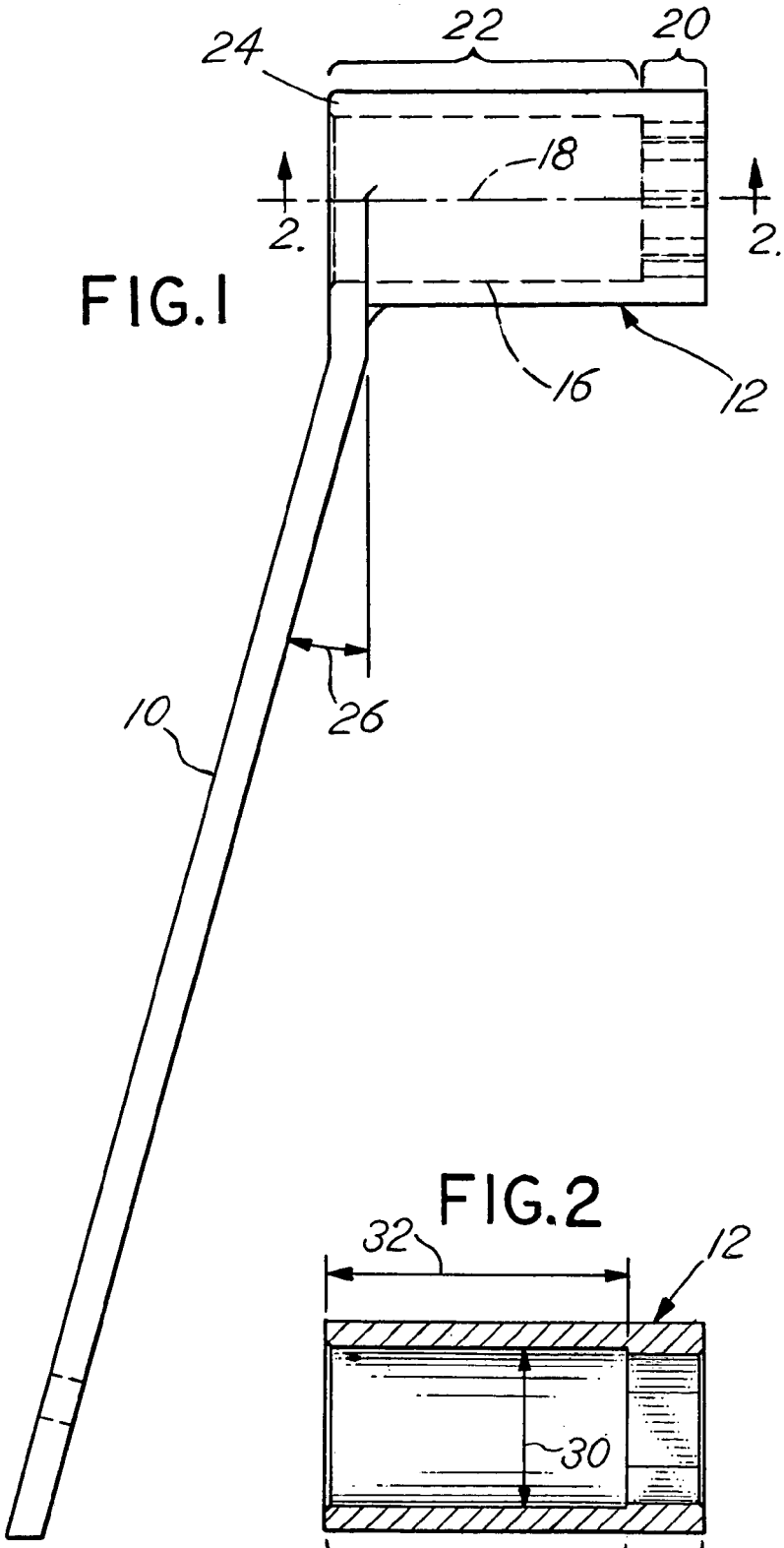
FIG.1
FIG.2
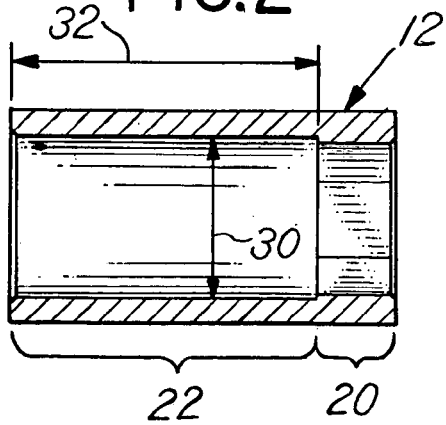
FIG.3
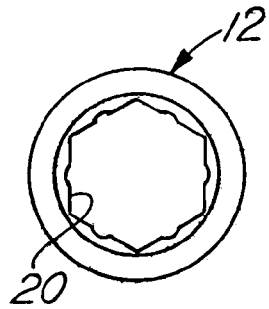

FIG. 7
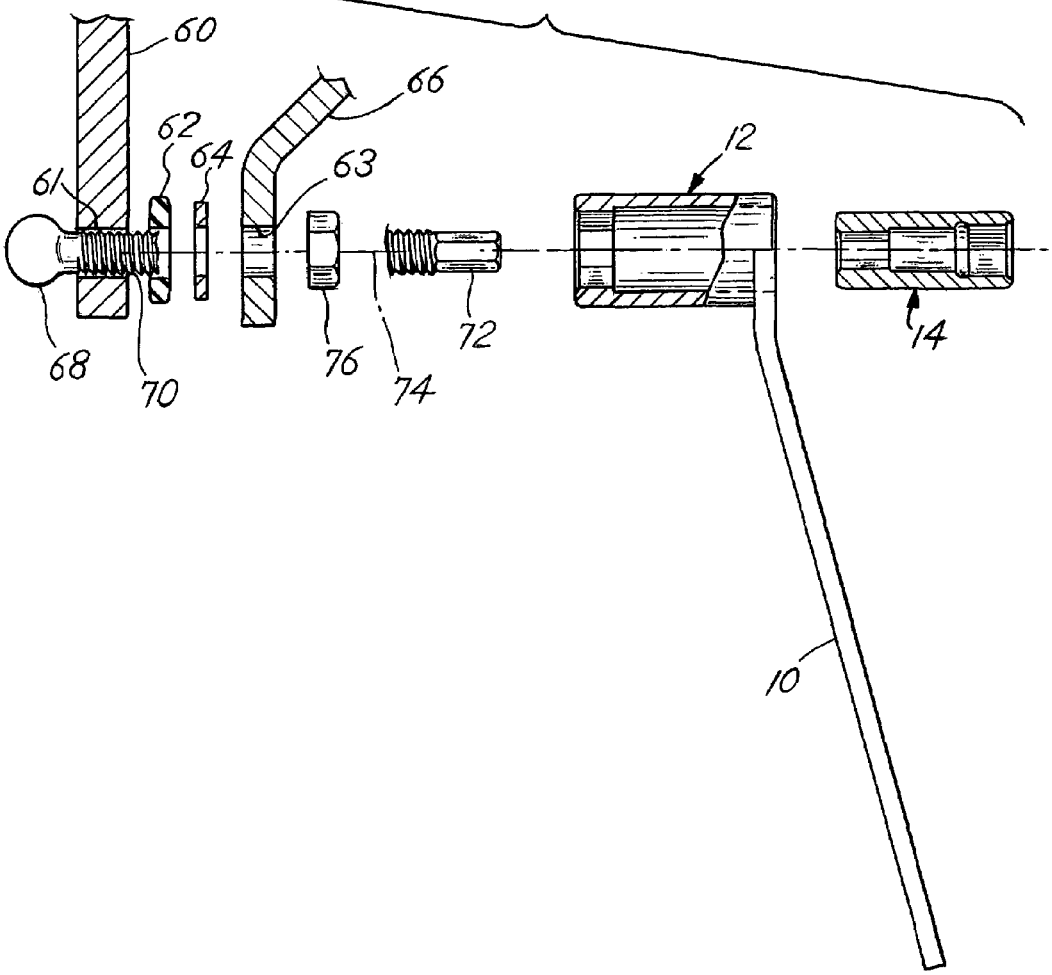
FIG. 5
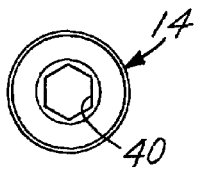
FIG. 4
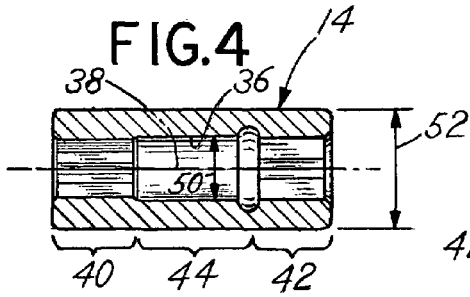
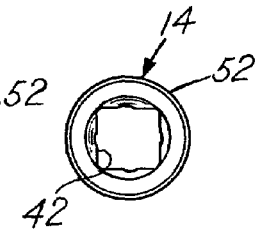
FIG. 6

STABILIZER LINK REMOVAL TOOL FOR VEHICLES

BACKGROUND OF THE INVENTION

In a principal aspect the present invention relates to a tool for removal and replacement of fasteners comprised of a nut on a stabilizer bar link ball shaped joint bolt having a round or oval head, a threaded shaft and a polygonal, internal polygonal, TORX® shape, internal TORX® shape, or otherwise non-circular configured tip on the shaft. Such fasteners may be used to connect linkage arms in a vehicle suspension system, for example.

Stabilizer links are typically incorporated in the front end assembly of a vehicle suspension system. Stabilizer links connect the wheel support assembly of the suspension system to the vehicle chassis or undercarriage. From time to time such links may require repair and/or replacement. Typically, such links are incorporated in the suspension system by attachment thereof by means of a round or oval headed, threaded bolt and a nut with various washers, grommets and the like, incorporated in the attachment assembly. However, the stabilizer link may have a configuration or shape which renders access thereto inconvenient and difficult. Thus, removal of such a link may be especially challenging.

Many Ford Motor Company vehicles, for example, incorporate such a front stabilizer end link that is difficult to access. That is, such a link has a configuration or shape wherein the end of the link attached to the wheel support assembly is recessed relative to the lower control arm approximately two inches. Access to the end of the link, in order to remove the nut from the threaded fastener holding the link in position is thus extremely limited. Consequently, heretofore, in order to remove the round or oval headed fastener in the form of a bolt and thus disengage the link could require two mechanics. One mechanic would position a pry-bar against the link to hold or fix it in position. The other mechanic would then attempt to place a socket on the nut and turn the nut in order to remove it from the bolt holding the link in position. Because of the inaccessibility of the end of the link and the potential necessity of two workmen in order to remove, repair and replace such a linkage repair is often expensive and, of course, difficult. Thus, there developed a need for a tool and a methodology which would simplify the disengagement or removal of the round or oval headed bolt and the nut attaching such a linkage element.

SUMMARY OF THE INVENTION

Briefly, the present invention comprises a tool which can be used to effect removal and/or replacement of a fastener (i.e. a bolt) for a stabilizer link in a vehicle suspension system, wherein the link is fastened into the system by means of a nut and the threaded fastener which is headed at one end and has a non-circular (generally polygonal) cross-section opposite end or tip. The tool which is used to effect such removal includes a first socket with a radially projecting handle at one end of the socket. The first socket includes a throughbore which is designed to engage the nut that retains the attachment bolt or fastener for the link. The throughbore in the first socket is also designed or configured to receive a second separate socket which may be rotatably inserted into the throughbore in the first socket at the end at which the first socket is attached to the handle to thereby engage the non-circular end or tip of the retention fastener or bolt that holds the link in position. Then a socket drive, either manual, pneumatic, or otherwise powered, may be engaged with the second socket to rotate that second socket relative to the first socket as the first socket is maintained rigidly in position by gripping the handle for the first socket. The first and second sockets, thus, are coaxial with the fastener for the link when in use and may be engaged with the fastener nut and, the fastener, respectively. The first socket engages the nut and the fastener or threaded bolt is engaged by the second socket. Thus, the first socket is adapted to fit over the nut of the linkage fastener and to simultaneously receive the second socket which may be rotatably positioned within the first socket to engage the non-circular tip or end of the bolt.

It is an object of the invention to provide an improved tool for removal of the fasteners for end links in a suspension system, particularly those associated with various Ford Motor Company products and other motor vehicles.

Another object of the invention is to provide a link fastener removal tool which may be utilized by a single mechanic to efficiently remove a link fastener.

Another object of the invention is to provide a rugged, efficient, yet economical and appropriately strong fastener removal tool.

These and other objects, advantages and features of the invention will be set forth in the detailed description which follows.

BRIEF DESCRIPTION OF THE DRAWING

In the detailed description which follows, reference will be made to the drawing comprised of the following figures:

FIG. 1 is a side elevation of a first socket and handle assembly;

FIG. 2 is a cross-sectional view of the first socket associated with the handle of FIG. 1 taken along the line 2--2;

FIG. 3 is an end view of the socket of FIG. 2;

FIG. 4 is a cross-sectional view of the second socket which is designed to fit within and be rotatably received by the first socket;

FIG. 5 is a driven-end view of the socket of FIG. 4;

FIG. 6 is an end view of the second socket of FIG. 4 viewed from the drive end thereof;

FIG. 7 is an exploded side view illustrating the component parts of a linkage and the socket tool of the invention, which may be utilized to remove the fastener holding the linkage arm or link engaged in a steering assembly of a vehicle;

DESCRIPTION OF THE PREFERRED EMBODIMENT

Figure 8:
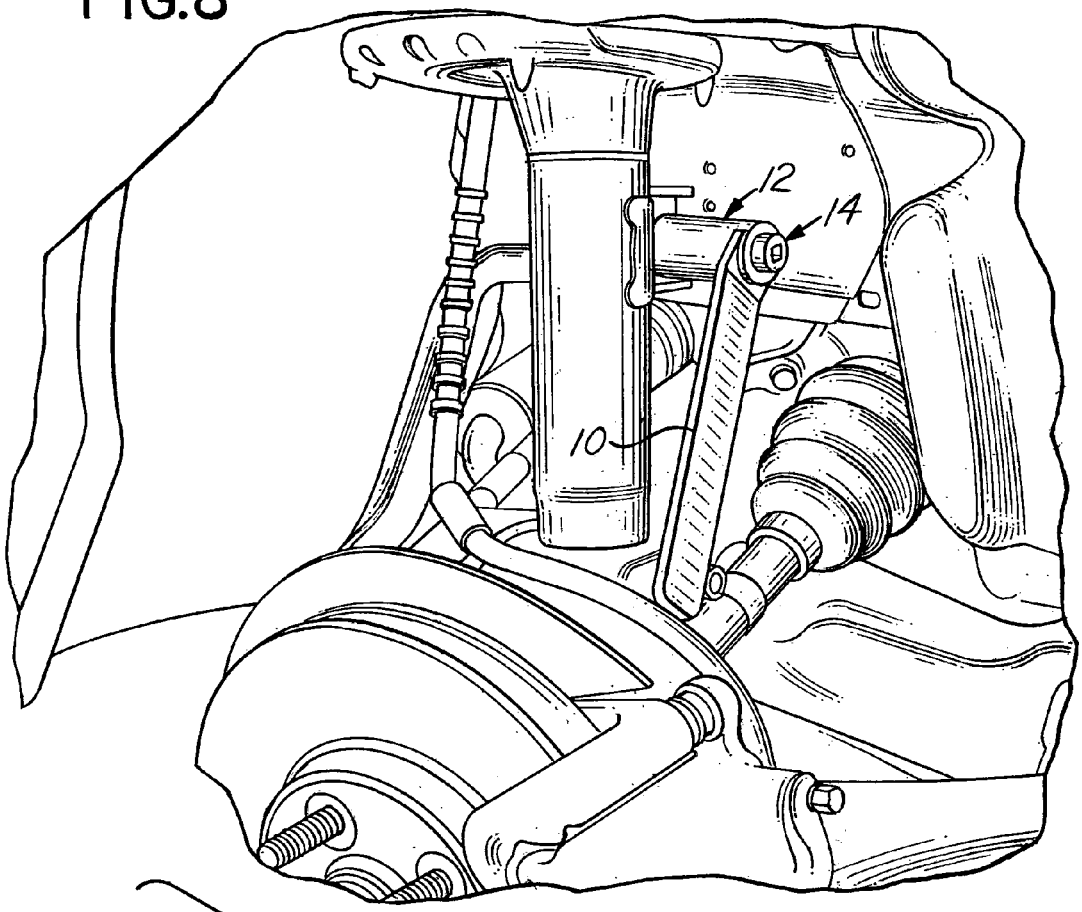
FIG. 8 is an isometric view illustrating the position of the various component parts of the tool of the invention in association with a linkage arm.

The tool of the invention is comprised generally of two separate component parts. The first part is illustrated in FIGS. 1, 2 and 3. The first component part of the tool comprises a handle 10 in combination with a first socket 12. The second part of the tool is illustrated in FIGS. 4, 5 and 6. FIGS. 4, 5 and 6 illustrate a second socket 14. The remaining figures illustrate the combination of the two parts of the tool and their utility.

The first socket 12 includes a throughbore 16 and a longitudinal axis 18. The first socket 12 further includes a nut-engagement end or section 20 and a second socket receiving end or section 22. The first or nut-engagement end 20 and the second socket receiving end 22 are coaxial. Outer end 24 of the first socket 12 has a planar handle 10 welded thereto. The handle 10 extends generally radially from the axis 18 and, in the preferred embodiment, forms an angle 26 of approximately 15°±5° with axis 18. The length of the handle 10 is in the range of 4-8 inches. The handle 10 may include a grip 17 to facilitate comfort during manual gripping of the handle 10.

The nut-engaging end 20 has an internal hexagonal configuration so that it may fit over a nut associated with a linkage as discussed hereinafter. The second socket receiving end 22 comprises a cylindrical, axial counterbore having an internal or counterbore diameter 30. The counterbore 22 extends axially to define an axial dimension 32 for receipt of the second socket 14. The axial dimension 32 is typically in the range of 1.5-2 inches.

As shown in FIGS. 4, 5 and 6, the second socket 14 includes an axial throughbore 36 having a longitudinal axis 38 with a driven end 40, a drive end or section 42 and an intermediate or connecting section 44. The sum of the axial dimensions associated with the sections 40, 42 and 44 is typically greater than the axial dimension 32 of the counterbore 22 of the first socket 12. This ensures that the second socket 14 will engage the driven end 40 thereof with a linkage bolt 68 and simultaneously will provide for appropriate engagement with a socket drive at the drive end 42. It should be noted that the intermediate section 44 has an internal diameter 50 which preferably is greater than the maximum radial dimension of the internal passage in driven end 40. In practice, the bore or passage at the driven end 40 will have a hexagonal polygonal cross-sectional internal configuration or shape. The socket bore or passage at the drive end 42 will have a square or rectangular shape for receipt of a socket drive device, either manual or otherwise powered. The second socket 14 includes, along the length thereof designed to fit within the bore 30, an outside diameter 52 which is slightly less than the internal diameter 30 of the counterbore 22 of the first socket 12. Thus the second socket 14 may rotatably fit within the first socket 30. These dimensional characteristics comprise important features of the invention in order to render the various parts to have appropriate utility.

Figure 9:
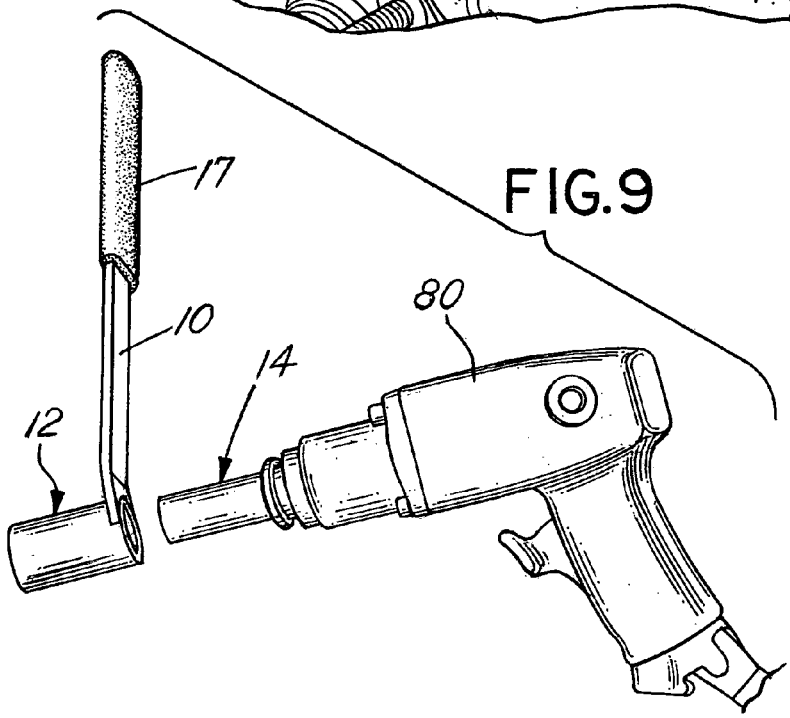
FIG. 9 is an isometric view of the complement parts comprising the first socket and associated handle or lever arm and the second socket as it would be incorporated or driven by a pneumatic tool.

FIGS. 7, 8 and 9 illustrate in greater detail the method of use of the tool. As depicted in FIG. 7, a link 60 includes an opening 61 for a fastener coaxially aligned with a rubber grommet 62, a washer 64 and a passage 63 of an attachment bar or second linkage member 66. The link 60 is attached to the second linkage member 66 by means of an oval headed bolt 68 with a shaft having a threaded section 70 and an outer polygonal or other non-circular cross section end 72. The end 72 is typically externally hexagonal. However, other external or internal non-circular shapes may be used. The link 60, grommet 62, washer 64 are assembled coaxially along the axis 74 and retained together by means of a nut 76 which is threaded onto the threaded section or portion 70 of the fastener or bolt 68.

In order to achieve access to the fastener 68 and nut 76 to affect removal of the nut 76, the first socket 12 and, more particularly, the nut engagement end 20 thereof is fitted over the nut 76. The handle 10 facilitates such placement. Next, the driven end 40 of the second socket 14 is fitted over the polygonal or hexagonal end or tip 72. The drive end 42 is then driven by means of a manual or pneumatic tool to disengage the headed fastener 68 from the nut 76. The handle 10 is retained in a generally unmoved position during nut 76 removal. In this manner, the linkage 60 is detached from the attachment linkage 66. The inside diameter of the first socket 12 is sized so that the second socket 14 may rotate therein. The axial length of the second socket 14 relative to the socket receiving end 22 of the first socket 12 is such that a socket drive (e.g. driver 80) may engage and rotationally drive the second socket 14. The second socket 14 includes a driven end 40 that fits over the polygonal section 72 of the bolt or headed fastener 68. Fastener 68 typically projects into the intermediate section 44 of second socket 14 and simultaneously permits a socket drive 80 to engage the drive end 42 of the second socket 14. The reverse operation may be effected to reattach the links 60 and 66. Most often, however, the tool is used to facilitate removal of a link 60 from the attachment link 66.

FIG. 8 illustrates the almost inaccessible position of the linkage and how the tool enables placement of the first socket 12 and the second socket 14 so as to cause appropriate removal of the headed fastener 68. FIG. 9 illustrates the manner in which the second socket 14 may be fitted in to the first socket 12 held by the handle 10 and driven by a pneumatic driver or tool 80.

The tool of the invention may be utilized in other environments beyond those described herein to affect disengagement or removal of an appropriate headed bolt from a nut which otherwise retains the bolt in a fixed position, whether it be part of a vehicle or other mechanical device. Variations of the tool may also be adopted, such as the length of the sockets, the diameters of the sockets, the length of the handle, the angular relationship between the handle and the first socket in order to customize the tool for a particular project. Therefore, the invention is to be limited only by the following claims and equivalents thereof.

What is claimed is:

1. A tool for removal of a threaded fastener for a stabilizer link in a vehicle, said link fastened to the vehicle by a separate nut on the threaded fastener, said fastener having a head at one end and a generally non-circular cross section opposite end, said tool comprising, in combination:

a first, generally annular socket having a throughbore with a nut engagement end and a second socket receiving end, said nut engagement end of said throughbore configured to engage and seat on the nut of said threaded fastener, said second socket receiving end of said throughbore having a generally uniform cross-sectional diameter, said nut engagement end coaxial with said second socket receiving end;

a handle extending generally radially from the first socket and attached to said first socket generally at the second socket receiving end; and a second socket having a generally annular configuration with a throughbore and a generally uniform outside diameter, a socket drive end and a socket driven end, said socket driven end throughbore configured to seat on said opposite end of said fastener, said socket drive end throughbore configured to receive a socket drive, said outside diameter of said second socket generally less than the cross-sectional throughbore diameter of the first socket receiving end, whereby the first socket may be positioned on said nut and restrained from rotation by maintaining the handle in a generally fixed position and the second socket driven end may be engaged with the opposite end of said fastener and rotationally driven to unthread the nut from the threaded fastener, the axial dimension of the first socket comprised of the axial dimension of the nut engagement end and the axial dimension of the socket receiving end, and wherein the second socket has an axial dimension greater than the axial dimension of the first socket, and said second socket throughbore includes an intermediate section between the socket driven end and the socket drive end, said intermediate section having a diameter greater than the maximum radial dimension of the driven end of the second socket, said second socket slidably removable from the first socket.

2. The tool of claim 1 wherein the handle extends radially from the axis of the first socket at an angle of 15°±5° from a normal radius to said axis.

3. A method for removal of a stabilizer link of a vehicle suspension system having a threaded fastener with a headed end, a non-circular end opposite the headed end and a nut threaded onto the threaded fastener utilizing the tool of claim 1 comprising the steps of:

a) positioning said first generally annular socket having a throughbore with a nut engagement end and a second socket receiving end, placing the nut engagement end onto said threaded fastener, said nut engagement end configured to engage and seat onto the nut onto said threaded fastener, said second socket receiving end having a cross-sectional diameter;

said annular socket including said handle extending generally radially from the first socket generally at the second socket receiving end;

b) positioning said second socket having a generally annular configuration with a throughbore and a generally uniform outside diameter, a socket drive end and a socket driven end, said throughbore at the socket driven end configured to seat on said end opposite of said fastener, said socket drive end throughbore configured to receive a socket drive, said outside diameter less than the cross-sectional diameter of the first socket throughbore at the second socket receiving end whereby the first socket may be positioned on said nut and restrained from rotation by maintaining the handle in a non-rotated position and the second socket may be engaged with the end opposite and rotationally driven to unthread the nut from the threaded fastener by placement of the driven end on the polygonal opposite end; and c) rotating the second socket to unthread the nut from the bolt.

* * * * *